US006565286B2

(12) United States Patent
Carr et al.

(10) Patent No.: US 6,565,286 B2
(45) Date of Patent: May 20, 2003

(54) METHOD FOR FABRICATING AND ASSEMBLING A FLOATING OFFSHORE STRUCTURE

(75) Inventors: Thomas N. Carr, Sugarland, TX (US); Cheng-Yo Chen, Houston, TX (US); Robin M. Converse, Houston, TX (US); Robert M. Harrell, Sugarland, TX (US); Daniel M. Houser, Houston, TX (US); Charles F. Kasischke, Houston, TX (US); Gautam K. Chaudhury, Houston, TX (US)

(73) Assignee: SparTec, Inc., Houston, TX (US)

( * ) Notice: Subject to any disclaimer, the term of this patent is extended or adjusted under 35 U.S.C. 154(b) by 0 days.

(21) Appl. No.: 09/928,201

(22) Filed: Aug. 10, 2001

(65) Prior Publication Data

US 2003/0031516 A1 Feb. 13, 2003

(51) Int. Cl.[7] ..... E02B 17/00
(52) U.S. Cl. ..... 405/204; 405/205; 405/206
(58) Field of Search ..... 405/203, 204, 405/205, 206, 207, 208, 209, 224, 195.1

(56) References Cited

U.S. PATENT DOCUMENTS 2,586,966 A * 2/1952 Kuss et al. ..... 405/203
2,857,744 A * 10/1958 Swiger et al. ..... 405/208
3,572,041 A * 3/1971 Graaf ..... 405/205
3,641,774 A * 2/1972 Hekkanen et al. ..... 405/204
3,859,806 A * 1/1975 Guy et al. ..... 405/204
3,876,181 A * 4/1975 Lucas ..... 405/205
4,629,365 A * 12/1986 Kuriiwa ..... 405/204
4,729,695 A * 3/1988 Silvestri ..... 405/203
4,825,791 A * 5/1989 Foster et al. ..... 405/203
6,135,673 A * 10/2000 Horton et al. ..... 405/205

* cited by examiner

*Primary Examiner*—Heather Shackelford
*Assistant Examiner*—Frederick L. Lagman
(74) *Attorney, Agent, or Firm*—D. Neil LaHaye; Robert C. Baraona; Eric Marich

(57) ABSTRACT

A method for fabricating sections of a floating offshore spar type structure and mating the sections offshore. A buoyant hard tank is fabricated vertically. The hard tank is then transported in a vertical orientation to a site where it is mated to a truss section of the spar structure offshore while the hard tank and truss section are both in the vertical orientation. The mated tank and truss sections are then towed in the vertical orientation to the operational site. The hard tank is fabricated with a larger diameter and correspondingly shallower draft than a more traditionally proportioned hard tank.

8 Claims, 10 Drawing Sheets

METHOD FOR FABRICATING AND ASSEMBLING A FLOATING OFFSHORE STRUCTURE

BACKGROUND OF THE INVENTION

1. Field of the Invention

The invention is generally related to the construction and assembly of floating offshore structures and more particularly to the construction and assembly of a spar type structure.

2. General Background

Unlike ships which can be fully assembled at an inshore facility, many types of oil drilling and production facilities for the offshore oil production industry require part of the assembly to take place either at the field location itself or at another offshore site prior to the tow to the field location. Due to the deep draft of Spar type platforms, the traditional construction sequence involves joining the structural sections of the hull in the horizontal position, transporting the completed hull in the horizontal position, followed by upending of the entire Spar to the vertical position at a site with sufficiently deep water to accommodate the deep draft.

The structural sections may consist of either plated hull tank sections only or a combination of plated tank and truss type sections. Such Spar type platforms are described in U.S. Pat. Nos. 4,702,321 and 5,558,467.

As a consequence of a horizontal assembly and transport followed by an upending sequence, numerous restrictions come into play that complicate and limit the size of the hull that can be constructed. This can result, depending on geographical location, in any or all of the following.

- Draft of the assembled hull in a horizontal orientation exceeds the dredged depths in inland navigable channels for wet tow to the offshore site.
- Draft of hard tank or truss sections in horizontal orientation exceeds water depths in inshore assembly areas, dry dock sill clearance depths, and/or heavy lift vessel maximum deck submergence depths. The draft restrictions imposed by fabrication facilities and transportation equipment limit the size of hulls that can be constructed.
- Assembly of hull marine systems and mooring equipment in the horizontal orientation rather than the vertical operating orientation complicates fabrication, fit-up, testing and pre-commissioning of this equipment, piping and wiring.
- Size and weight of hull in horizontal orientation exceeds the hydrodynamic stability and strength capabilities of the largest existing heavy lift transport vessels. This dictates transportation in sections for final horizontal assembly in an erection facility an acceptably short distance from the offshore site.

SUMMARY OF THE INVENTION

The invention addresses the above needs. What is provided is a vertical construction method. The hard tank is fabricated vertically. The hard tank is then transported in a vertical orientation to a site where it is mated to the truss section of the spar structure offshore while the hard tank and truss section are both in the vertical orientation. The mated tank and truss sections are then towed in the vertical orientation to the operational site. The hard tank is fabricated with a larger diameter and correspondingly shallower draft than a more traditionally proportioned hard tank.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
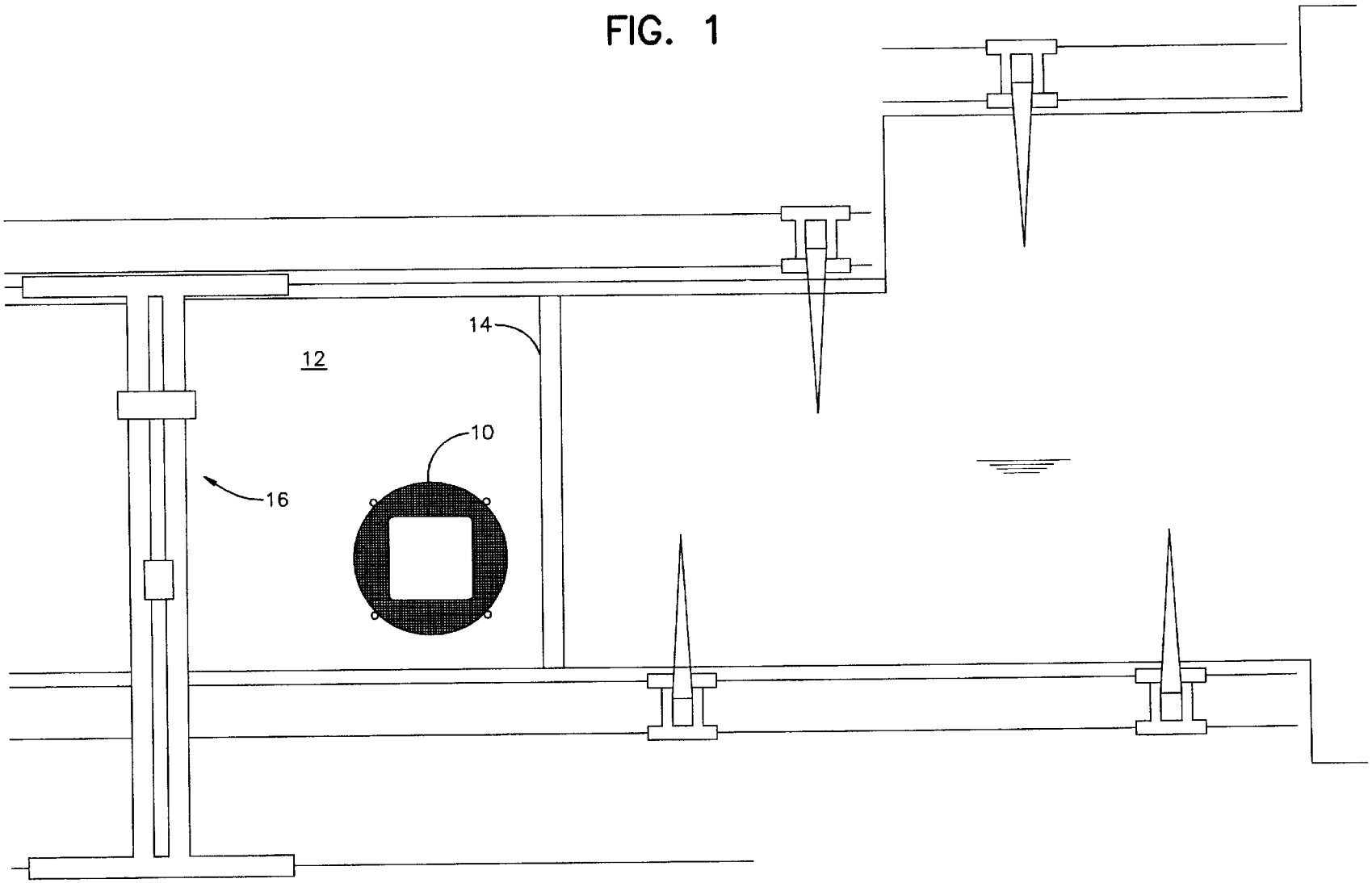
FIG. 1 is a plan view that illustrates the fabrication of the hard tank in a dry dock.
Figure 2:
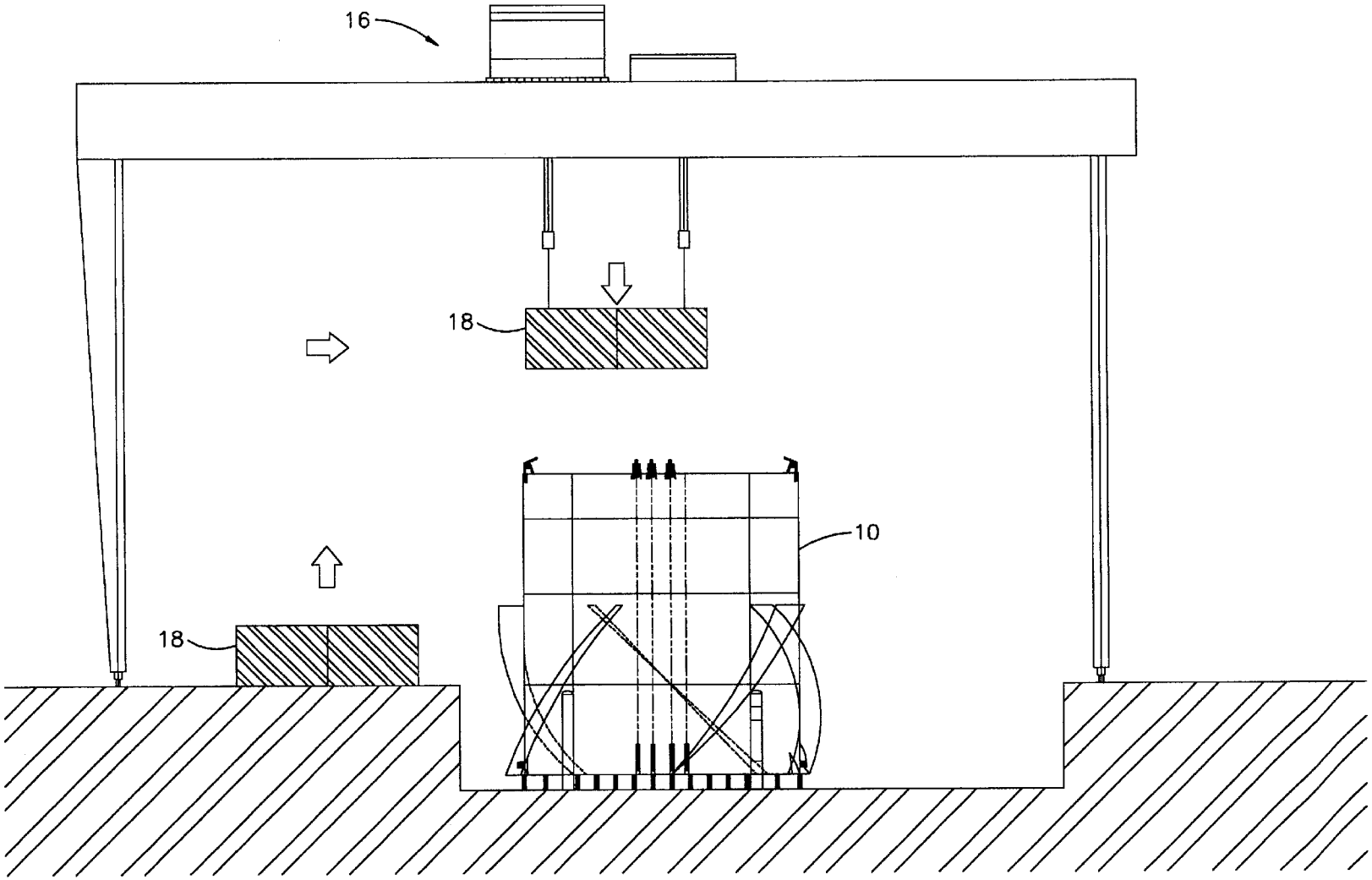
FIG. 2 is an elevation view that illustrates the fabrication of the hard tank in a dry dock.

FIGS. 1 and 2 illustrate the hard tank 10 under construction in a dry dock 12. During the construction phase, a movable gate 14 prevents seawater from entering the dry dock. As seen in FIG. 2, the hard tank 10 is fabricated in a vertical orientation by using a crane/trolley combination 16 to lift and position components 18 that are used to fabricate the hard tank 10.

Figure 3:
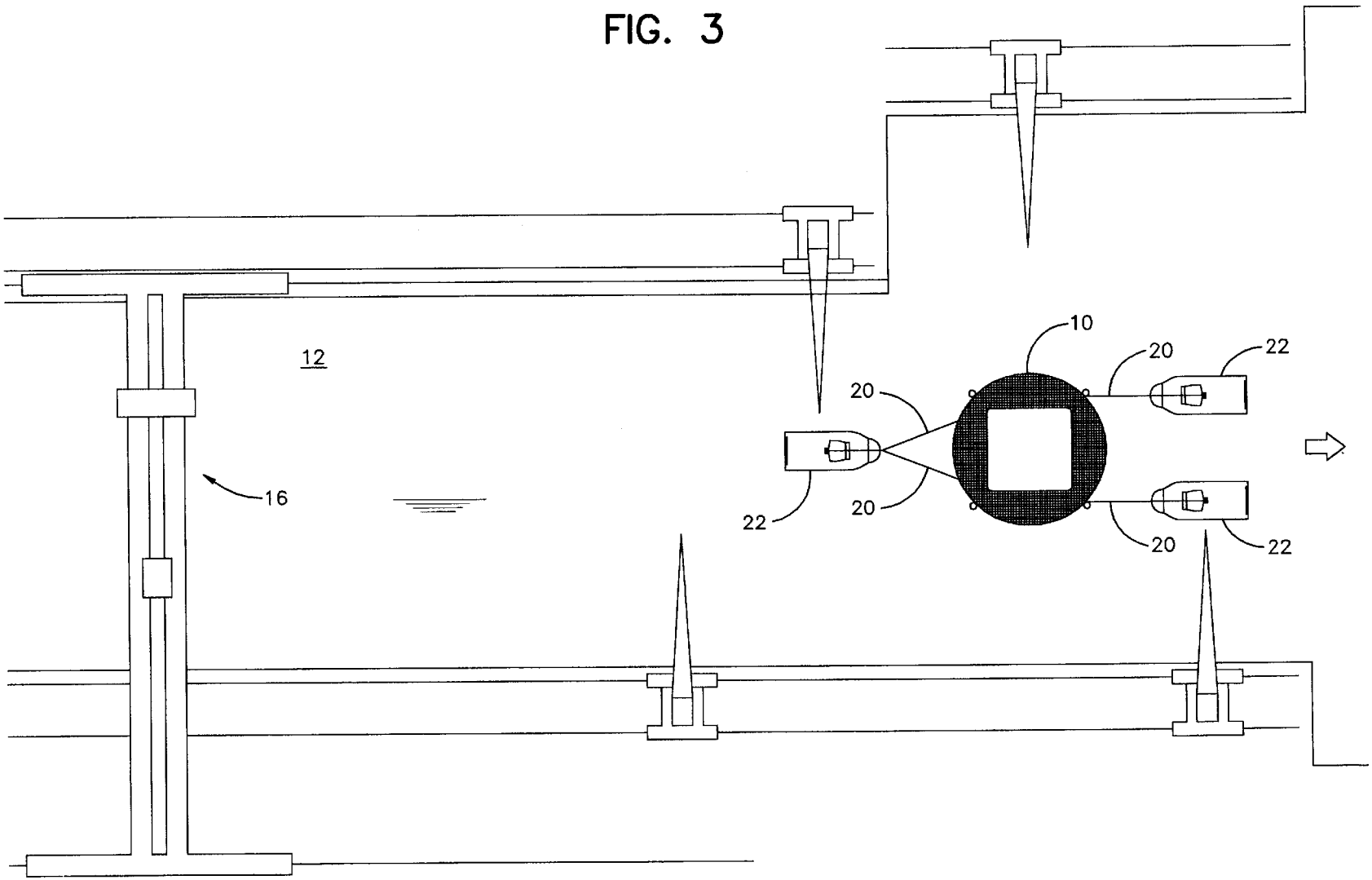
FIG. 3 is a plan view that illustrates the vertical tow out of the hard tank from the dry dock.
Figure 4:
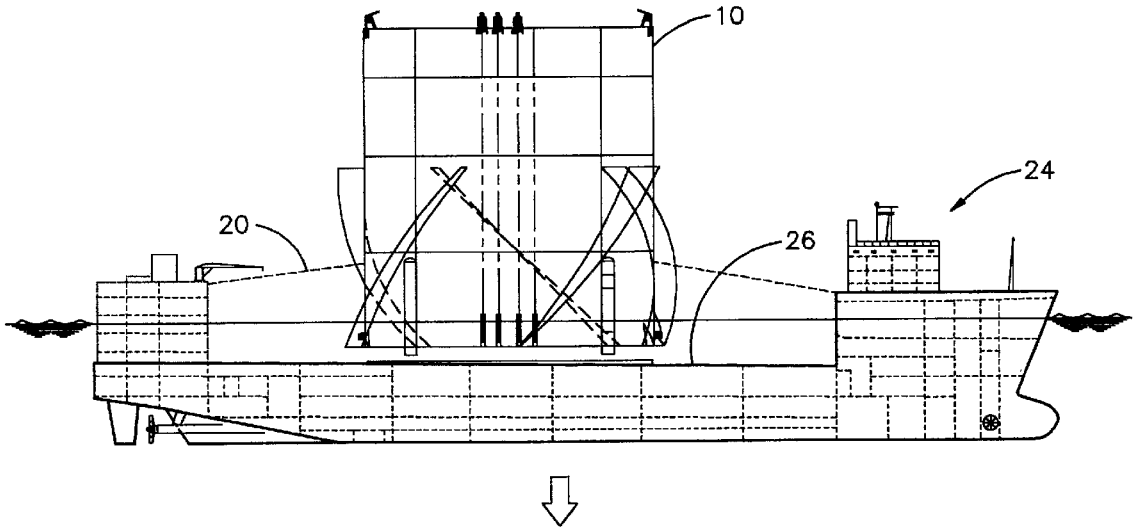
FIG. 4 illustrates the submergence of the heavy lift vessel in preparation for receiving the hard tank.
Figure 5:
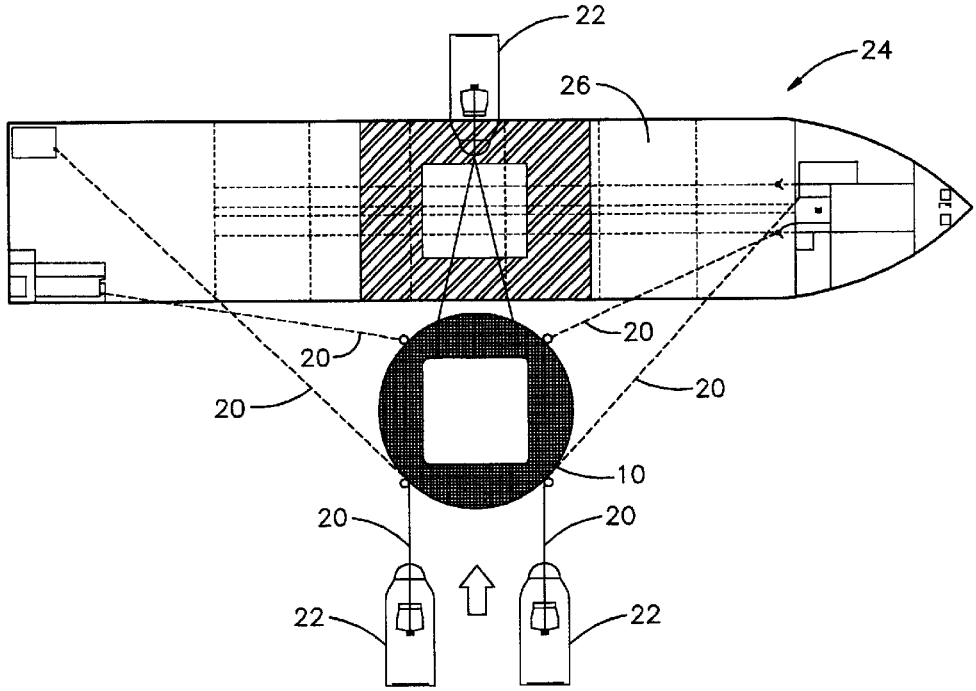
FIG. 5 is a plan view that illustrates the hard tank being moved into position over the deck of the heavy lift vessel.

After the hard tank 10 is completed, the dry dock 12 is flooded with seawater by removing the gate 14. Designed to be buoyant, the hard tank 10 floats in the flooded dry dock. The hard tank 10 is transported to a location for mating to the truss section. As seen in FIG. 3, lines 20 are attached between the hard tank 10 and tugboats 22. The tugboats 22 are then used to tow the hard tank 10 to open water where it may be loaded onto a heavy lift vessel.

Figure 6:
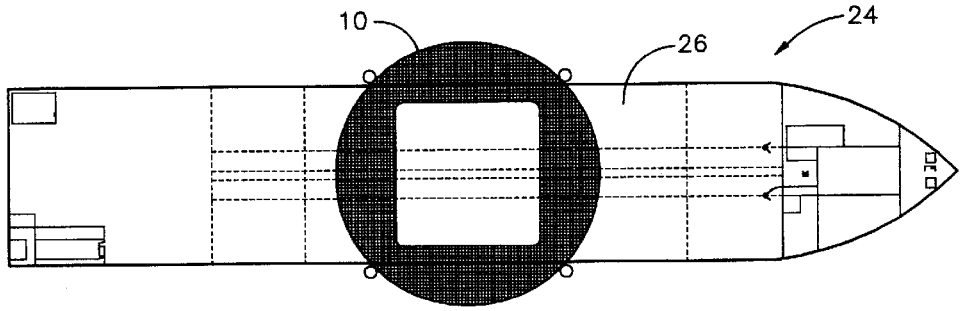
FIG. 6 is a plan view that illustrates the hard tank in position on the deck of the heavy lift vessel after the heavy lift vessel has been deballasted.
Figure 7:
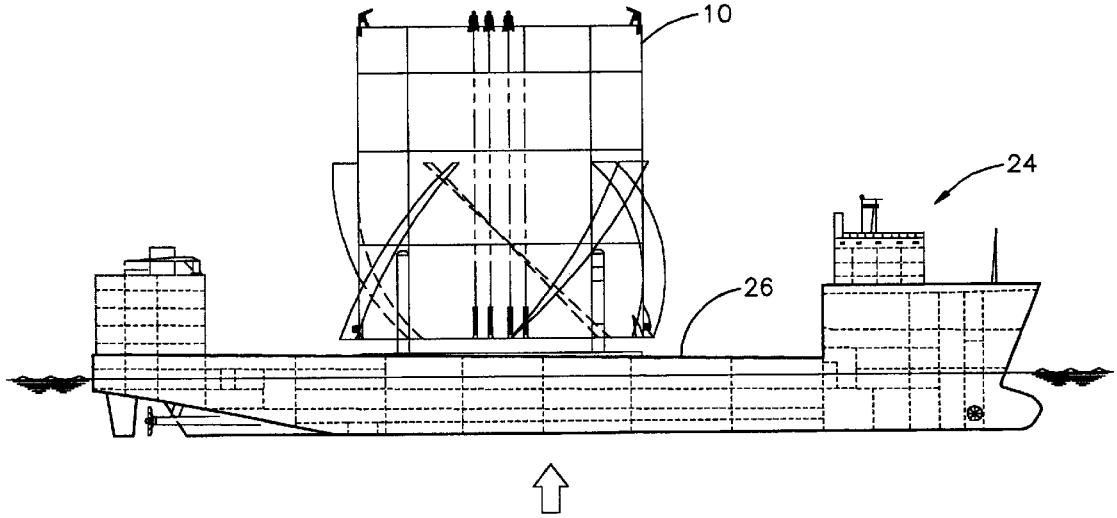
FIG. 7 is an elevation view that illustrates the hard tank in position on the deck of the heavy lift vessel after the heavy lift vessel has been deballasted.

As seen in FIGS. 4–7, a heavy lift vessel 24 is ballasted such that the cargo deck 26 is below the water surface at a depth greater than the draft of the hard tank 10. Lines 20 connected between the hard tank 10, tugboats 22, and the heavy lift vessel 24 are used to guide the hard tank 10 into position above the cargo deck 26. Once in the proper position, as seen in FIG. 6, the heavy lift vessel 24 is deballasted to raise the cargo deck 26 and hard tank 10 above the surface of the water as seen in FIG. 7. The hard tank 10 is secured in position and the heavy lift vessel 24 is used to transport the hard tank 10 to the site for mating with the truss section.

The truss section of the spar structure is constructed in a suitable location and manner. The truss section of a spar type structure is an open space frame such as that described in U.S. Pat. No. 5,558,467. Due to the height of the truss section, it is typically fabricated in a horizontal orientation.

Figure 9:
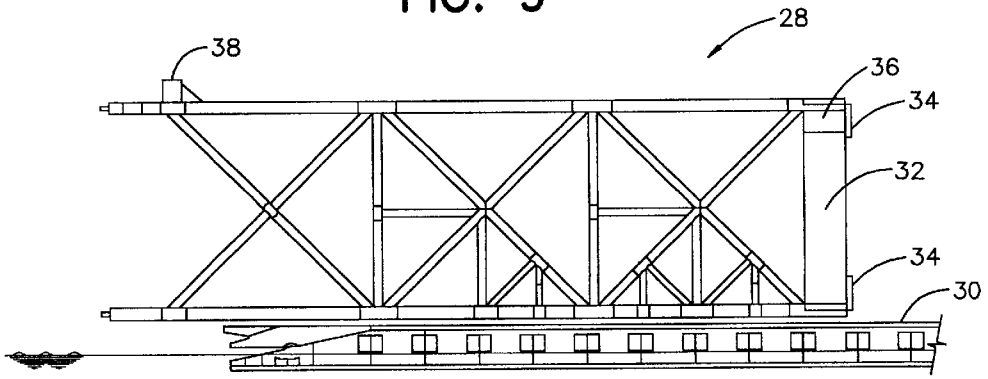
FIG. 9 illustrates the tow of the truss section of the spar to the assembly site.
Figure 8:
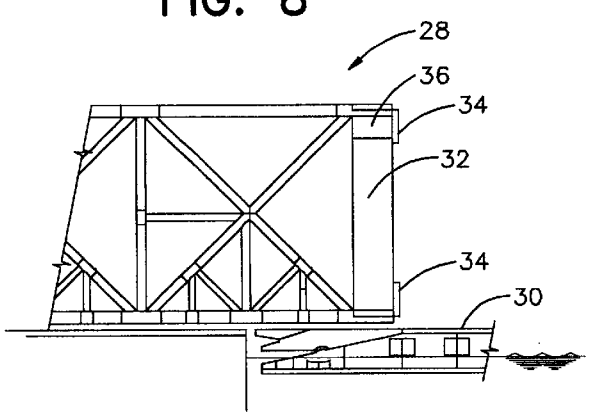
FIG. 8 illustrates the load out of the truss section of the spar onto a barge.

As seen in FIGS. 8 and 9, the completed truss section 28 is skidded onto a barge 30 for transport to the assembly site. The truss section 28 is provided with one or more fixed ballast tanks 32 and mud mats 34. At least one section 36 of the ballast tank is voided to provide temporary buoyancy after launch. The barge 30 is ballasted down to receive the truss section 28 and then deballasted to a shallower draft for transport of the truss section 28 to the assembly site.

Figure 11:
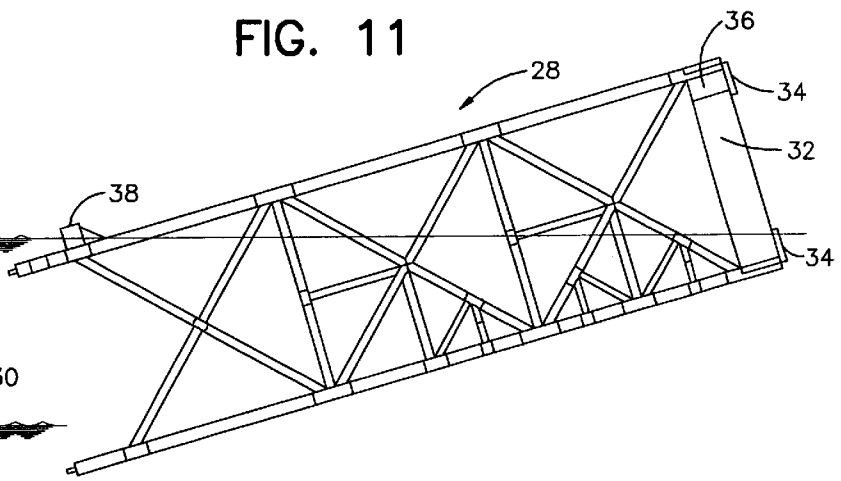
FIG. 11 illustrates the initial position of the truss section of the barge after it has been launched from the barge.
Figure 10:
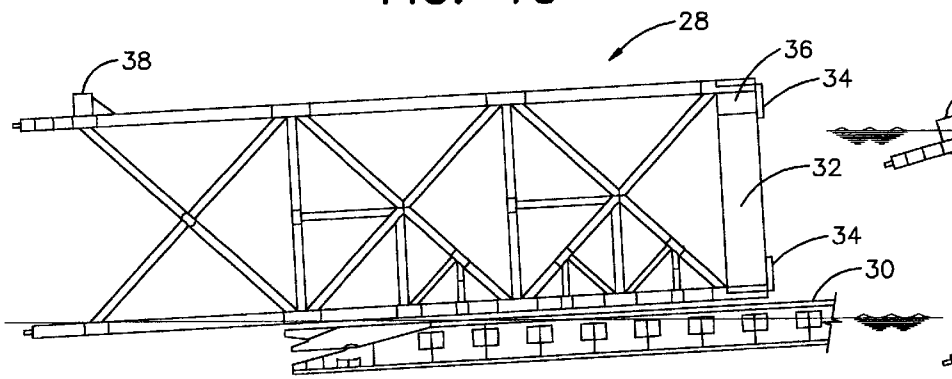
FIG. 10 illustrates the launch of the truss section of the spar from the barge.

Once at the assembly site, one end of the barge 30 is ballasted below the water surface as seen in FIG. 10 to facilitate launching of the truss section 28. FIG. 11 illustrates the initial position of the truss section 28 after launch. The end of the truss section that defines the upper end of the truss section when in the vertical orientation is provided with a temporary buoyancy tank 38 to float that end of the truss section.

Figure 12:
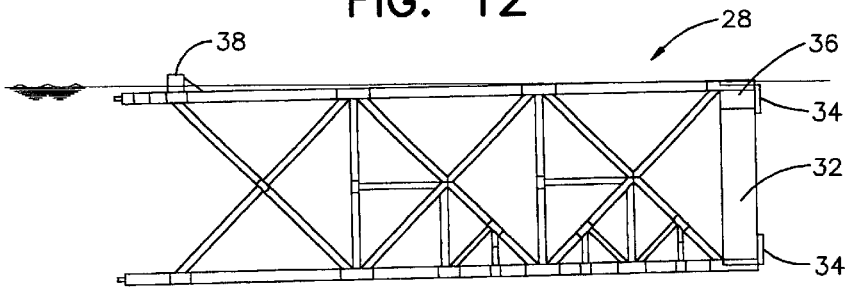
FIG. 12 illustrates the next position of the truss section of the spar after launch from the barge.
Figure 13:
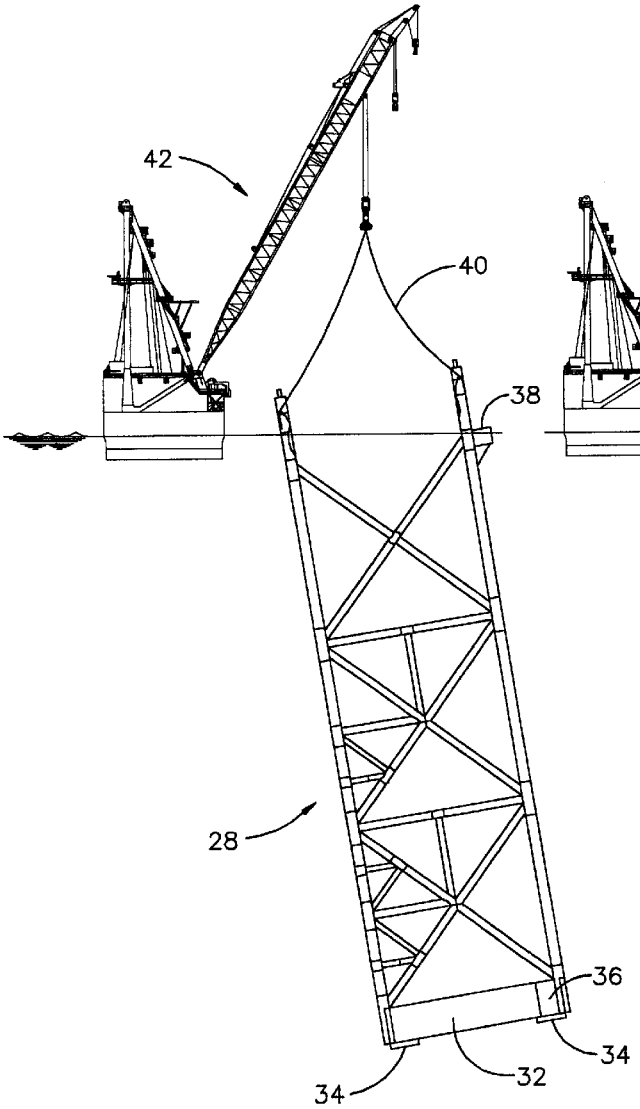
FIG. 13 illustrates the truss section of the spar after it has been upended.

The ballast tanks 32 are flooded. FIG. 12 illustrates the horizontal floating position of the truss section 28 after the ballast tanks 32 are beginning to flood. FIG. 13 illustrates the truss section 28 after the ballast tanks 32 have been flooded and the truss section has been upended.

Figure 14:
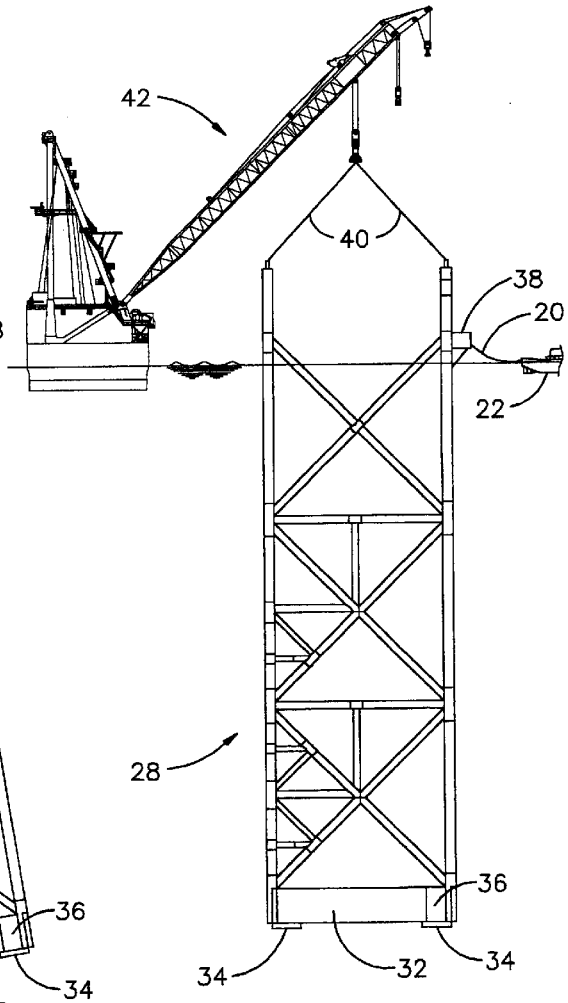
FIG. 14 illustrates the truss section of the spar in preparation for lowering to the sea floor.
Figure 16:
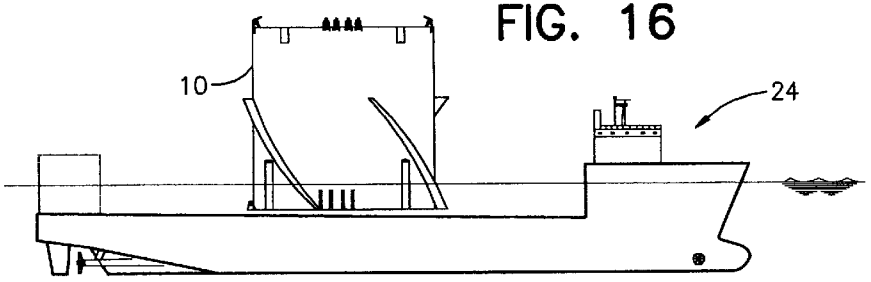
FIG. 16 illustrates the heavy lift vessel ballasted down in preparation to float off the hard tank.
Figure 17:
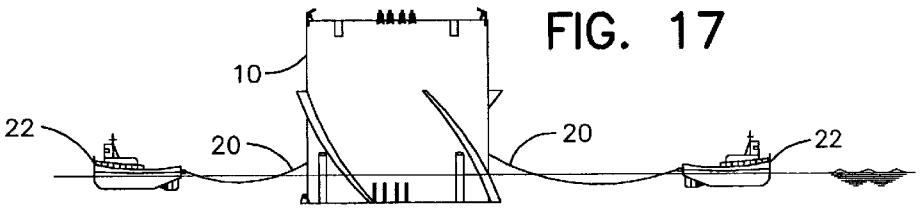
FIG. 17 illustrates the hard tank being moved in position to receive the truss section of the spar.
Figure 15:
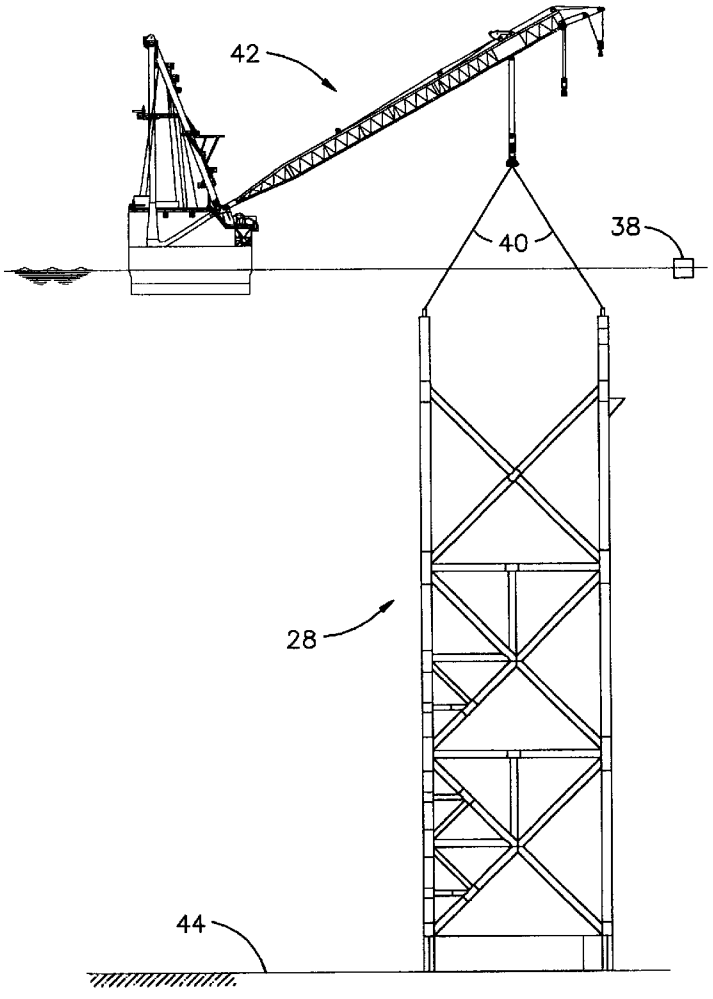
FIG. 15 illustrates the truss section of the spar after it has been set on the sea floor.
Figure 19:
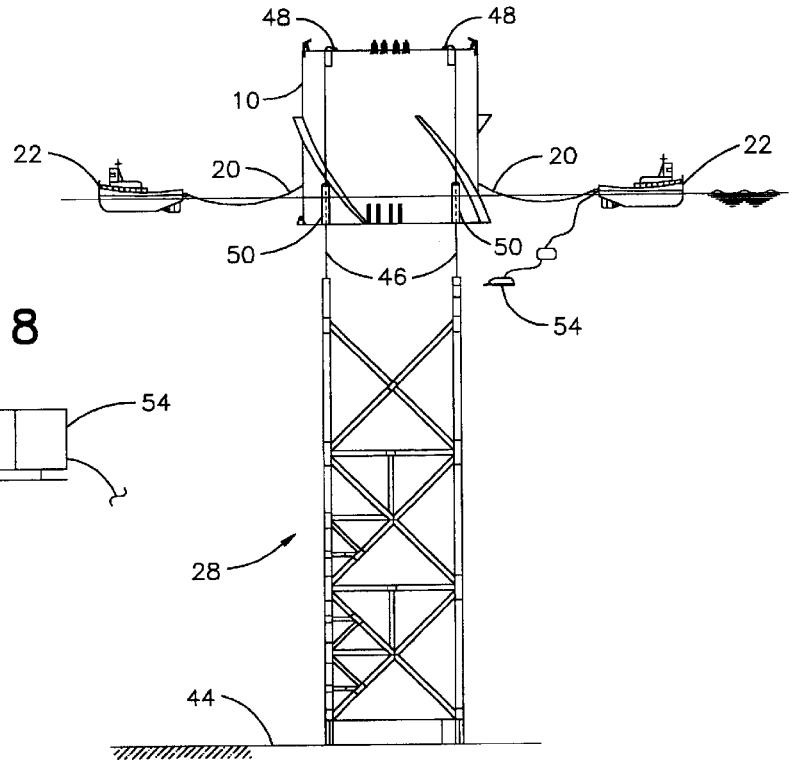
FIG. 19 illustrates the truss section connected to the winches on the hard tank.
Figure 18:
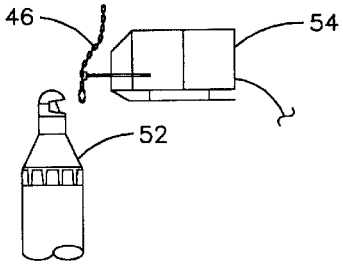
FIG. 18 is a detail view that illustrates a means of connecting the truss section to winches on the hard tank.
Figure 20:
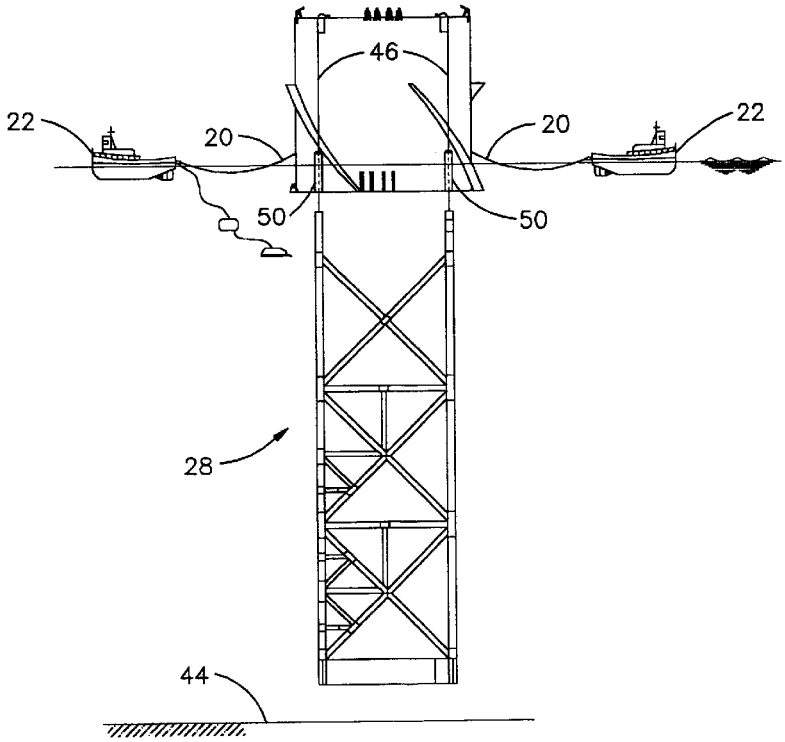
FIG. 20 illustrates the truss section being pulled up toward the hard tank.
Figure 21:
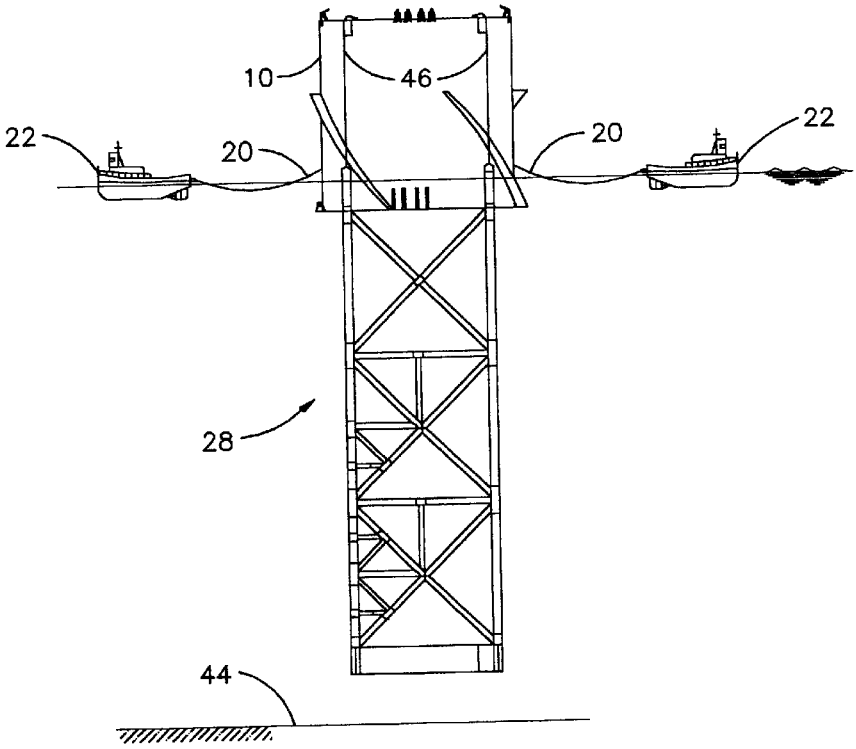
FIG. 21 illustrates the truss section in the mated position with the hard tank.

Slings 40 on the truss section 28 are attached to the crane 42 as seen in FIG. 14. The slings may be preinstalled on the truss section 28. The crane 42 is used to raise the truss section 28 such that it is vertically positioned in the water and the temporary buoyancy tank 38 is at or above the water surface. A line 20 is attached between the temporary buoyancy tank 38 and a tugboat 22. The temporary buoyancy tank 38 is cut away from the truss section 28. The truss section 28 is lowered as seen in FIG. 15, the temporary buoyancy tank 38 floats away, and the tugboat 22 and line 20 are used to tow the temporary buoyancy tank 38 away from the truss section 28. The upper portion of the truss section 28 is lowered below the surface of the water to provide a zero water plane area such that the lower end sits on the sea floor 44.

The positioning and mating of the hard tank 10 with the truss section 28 is illustrated in FIGS. 18–22. The heavy lift vessel 24 is ballasted down to a draft that allows floatation of the hard tank 10 off the heavy lift vessel 24.

Lines 20 attached between the hard tank 10 and tugboats are used to position the hard tank 10 above the truss section 28. Mating lines or chains 46 from winches 48 are run through the hard tank 10 and the stabbing receptacles 50 designed to receive stabbing posts 52 at the upper end of the truss section 28. The chains 46 are attached to the stabbing posts 52 of the truss section 28.

Figure 22:
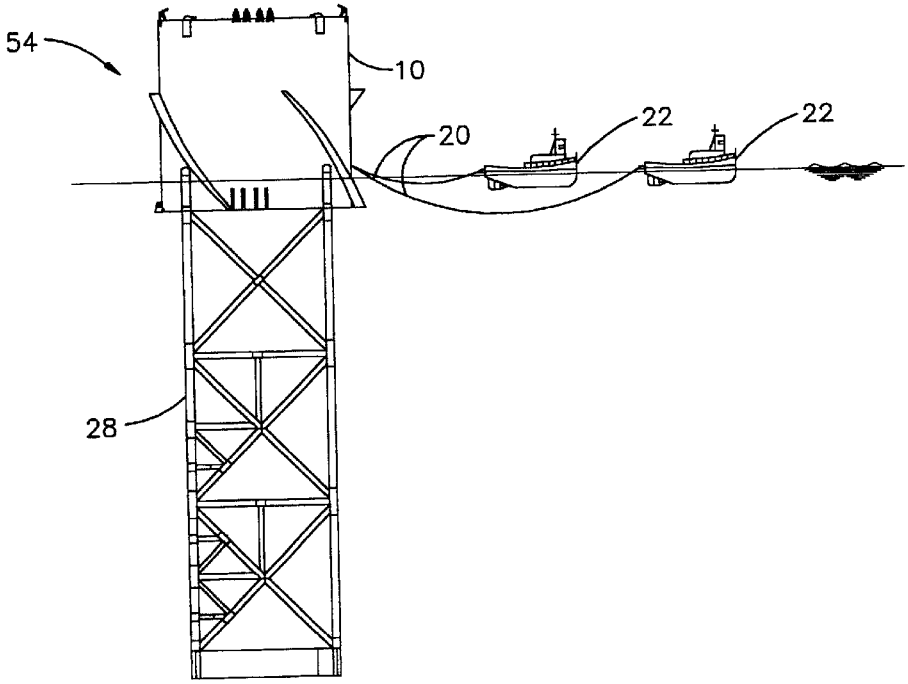
FIG. 22 illustrates the tow of the mated truss section and hard tank to the operational site.

The winches 48 on the hard tank 10 are used to pull the truss section 28 up off the sea floor and the stabbing posts 52 of the truss section 28 into the stabbing receptacles 50 in the hard tank 10. Once the stabbing posts 52 of the truss section 28 are fully received in the stabbing receptacles 50, the stabbing posts 52 and the receptacles 50 are shimmed and welded as necessary and grouted together. After the grout has set and temporary equipment removed, the assembled structure 54 is towed to the installation site in a vertical orientation as seen in FIG. 22.

An alternative to using winches to pull the hard tank and truss section together is to use a crane vessel to lift the truss section.

An alternative to launching the truss section at the mating site is to lift and lower the truss section using one or more crane barges.

An alternative to supporting the truss section on the sea floor at the mating site is to suspend the truss just off the sea floor by designing a slightly negative submerged weight pulling against clump weights suspended from the base of the truss section.

An alternative to fabricating the hard tank in a dry dock is to fabricate the hard tank in a fabrication yard and load it onto a submersible vessel by skidding. The submersible vessel is then used to transport the hard tank to a calm water location. The submersible vessel is submerged at the calm water location and the hard tank is floated off the vessel as illustrated in FIGS. 4–7.

The advantages of the vertical fabrication and assembly approach affect the fabricator, installer and operator, resulting in improvements in the reliability, operation and flexibility of both the design itself and the methods of construction.

There are several construction advantages for the hard tank.

Fabricating the cylindrical hard tank vertically is perfectly suited to shipyard, dry dock construction, including the use of normal dry dock supports due to the flat bottom of the hard tank.

The floating draft of the hard tank section can be controlled by the design to meet the draft restrictions of dredged navigation channels, dry dock sills, and heavy lift transport vessels.

Dimensional control, temporary erection steel, scaffolding and personnel access are all greatly simplified when erecting a cylinder upright instead of horizontally.

All the appurtenances, as well as all the hull systems and mooring equipment, can be installed and completely commissioned prior to shipment, since the hard tank is fabricated in its operating position.

The hull is delivered to the deepwater mating site without any remaining commissioning or structural work. There are no "field installed" appurtenances such as sections of strakes, boat landings, stairs and ladders, chain jacks, platforms, external casings, fire pumps, etc. There is no further commissioning needed for the hydraulic power unit, ballast pumps or the associated piping and instrumentation.

Load out and offload operations with the heavy lift transport vessel, as well as the associated support structure and tie downs, are intrinsically less complicated for the flat bottomed vertical cylinder while the VCG (vessel center of gravity) of the cargo is approximately the same as for the horizontal approach.

Vertical fabrication and assembly also provides design advantages. The affinity of the construction method for large diameters offers the Operator great latitude both in selecting the topside payload and in selecting the size of the center-well (moon pool) to accommodate any riser requirements.

The larger diameter hulls are more amenable to larger topside areas. Ultra large facilities may be required to accommodate two drilling rigs. The vertical configuration, with its larger center well, larger well spacing and larger deck areas, can be readily configured for two derricks plus the supporting packages and bulk storage.

Larger areas improve topside layout flexibility, including the opportunity to build in greater separation between the quarters and the hazardous areas.

Larger hull diameters provide more space on the top of the hull for equipment (chain, jacks, etc.) and piping.

Eccentric topside payloads have less impact on the static pitch response of the hull. This feature, like the larger available topside areas, also facilitates the use of dual rigs as they are skidded from well to well.

The shallower hard tank means there are fewer internal compartments, and those that remain are all closer to the water surface. This simplifies personnel access and reduces the number and lengths of the piping, access shafts, and other in hull appurtenances.

The construction method can be applied to hulls sized for fifty thousand to sixty thousand short ton topside payloads, and larger, with virtually no impact to the approach.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for fabricating sections of a floating spar type structure and mating the sections offshore, comprising the steps of:

a. fabricating a buoyant hard tank section in a vertical orientation;

b. fabricating a truss section;

c. submerging the truss section in a vertical orientation that provides a zero water plane area;

d. floating the hard tank above the truss section; and e. moving the truss section up to engage with the hard tank, with the hard tank section remaining in the water after engagement with the truss section and serving as the buoyant hull to support the floating spar type structure.

2. The method of claim 1, further comprising forming a permanent attachment between the hard tank and the truss section.

3. The method of claim 1, wherein the step of moving the truss section up to engage with the hard tank is accomplished using lifting equipment and lines.

4. The method of claim 1, further comprising providing stabbing receptacles in the hard tank and stabbing posts in the truss section.

5. A method for fabricating sections off a floating spar type structure and mating the sections offshore, comprising the steps of:

a. fabricating a buoyant hard tank section in a vertical orientation;

b. fabricating a truss section;

c. transporting the hard tank and truss sections to an offshore site, wherein the hard tank section is transported in a vertical orientation;

d. submerging the truss section in a vertical orientation that provides a zero water plane area;

e. floating the hard tank above the truss section; and f. moving the truss section up to engage with the hard tank, with the hard tank section remaining in the water after engagement with the truss section and serving as the buoyant hull to support the floating spar type structure.

6. The method of claim 5, further comprising providing stabbing receptacles in the hard tank and stabbing posts on the truss section.

7. The method of claim 5, further comprising forming a permanent attachment between the hard tank and the truss section.

8. The method of claim 5, wherein the step of moving the truss section up to engage with the hard tank is accomplished using lifting equipment and lines.

* * * * *